US008878445B2

(12) United States Patent
Takata et al.

(10) Patent No.: US 8,878,445 B2
(45) Date of Patent: Nov. 4, 2014

(54) LIGHT-EMITTING ELEMENT DRIVING DEVICE

(75) Inventors: Go Takata, Hyogo (JP); Shinichiro Kataoka, Osaka (JP); Yasunori Yamamoto, Osaka (JP); Tsukasa Kawahara, Kyoto (JP); Ryuji Ueda, Osaka (JP); Daisuke Itou, Osaka (JP)

(73) Assignee: Panasonic Corporation, Osaka (JP)

( * ) Notice: Subject to any disclaimer, the term of this patent is extended or adjusted under 35 U.S.C. 154(b) by 155 days.

(21) Appl. No.: 13/314,597

(22) Filed: Dec. 8, 2011

(65) Prior Publication Data

US 2012/0074856 A1 Mar. 29, 2012

Related U.S. Application Data

(63) Continuation of application No. PCT/JP2010/001493, filed on Mar. 4, 2010.

(30) Foreign Application Priority Data

Jun. 9, 2009 (JP) ..... 2009-138038

(51) Int. Cl.
*G09G 3/36* (2006.01)
*H05B 33/08* (2006.01)

(52) U.S. Cl.
CPC ..... *H05B 33/089* (2013.01); *H05B 33/0827* (2013.01); *H05B 33/0815* (2013.01)
USPC ..... 315/192; 315/129; 315/291; 345/102; 345/82

(58) Field of Classification Search
USPC ..... 315/149, 158, 224, 225, 86, 129, 272, 315/307, 192; 345/82, 102
See application file for complete search history.

(56) References Cited

U.S. PATENT DOCUMENTS

| | | | | |
|---|---|---|---|---|
| 7,876,103 | B2 * | 1/2011 | Mihai et al. | 324/414 |
| 7,948,468 | B2 * | 5/2011 | Zane et al. | 345/102 |
| 8,129,916 | B2 * | 3/2012 | Godbole | 315/225 |
| 8,253,339 | B1 * | 8/2012 | Godbole et al. | 315/149 |
| 2008/0202312 | A1 * | 8/2008 | Zane et al. | 84/297 R |

FOREIGN PATENT DOCUMENTS

| | | |
|---|---|---|
| JP | 2008-130513 | 6/2008 |
| JP | 2008-305941 | 12/2008 |
| JP | 2008-311602 | 12/2008 |

OTHER PUBLICATIONS

International Preliminary Report on Patentability issued Jan. 26, 2012 in International (PCT) Application No. PCT/JP2010/001493.
International Search Report issued Apr. 6, 2010 in International (PCT) Application No. PCT/JP2010/001493.

* cited by examiner

*Primary Examiner* — Vibol Tan
(74) *Attorney, Agent, or Firm* — Wenderoth, Lind & Ponack, L.L.P.

(57) ABSTRACT

Short circuit failures and open circuit failures of light-emitting elements used for the backlight in an LCD panel can be reliably and easily detected. The voltage at the node between each series-connected light-emitting element array and a drive circuit is detected as a monitored voltage. A maximum detector detects the highest and a minimum detector detects the lowest of these monitored voltages. Short circuit or open circuit failure of a light-emitting element is detected by comparing the voltage difference between the maximum detector output and the minimum detector output with a specific reference voltage.

35 Claims, 3 Drawing Sheets

LIGHT-EMITTING ELEMENT DRIVING DEVICE

CROSS-REFERENCE TO RELATED APPLICATIONS

This is a continuation application of International Application No. PCT/JP2010/001493, filed Mar. 4, 2010 entitled "LIGHT-EMITTING ELEMENT DRIVING DEVICE" and claims priority to Japanese Patent Application No. 2009-138038 filed Jun. 9, 2009, the content of which is incorporated by reference herein.

BACKGROUND OF THE INVENTION (1) Field of the Invention

The present invention relates to a light-emitting element driving device, and relates more particularly to a device that drives a light-emitting element such as a light-emitting diode (LED) connected to a power supply circuit.

(2) Description of Related Art

LEDs are increasingly used for backlights in liquid crystal display (LCD) panels. When LEDs are used as a backlight for an LCD panel (LCD backlight), a specific constant current is generally supplied to a plurality of LEDs connected in series, causing them to emit light. The number of LEDs and the amount of current supplied are determined according to the amount of required light. The drive voltage for driving the LEDs is produced by a voltage converter that converts the supply voltage to a specific voltage. This voltage converter controls the drive voltage by detecting the voltage or current at a specific part of the LED array (the load) in a feedback control loop. This type of LED drive technology is taught, for example, in Japanese Unexamined Patent Appl. Pub. JP-A-2008-130513.

The light-emitting element driving device taught in JP-A-2008-130513 is described briefly below with reference to FIG. 3.

The light-emitting element driving device according to this example of the related art detects the current supplied from a DC/DC converter 1 to the LED module 2 by means of a current detection resistor R1. A comparator 3 compares the detected voltage with a reference voltage Vref1, and based on the result of this comparison the PWM (pulse width modulation) controller 4 controls the DC/DC converter 1. A constant current supply can therefore be provided to the LED module 2. Control elements Q1 to Q3 rendering a current mirror circuit are also connected in series with the LED load circuits U1 to U3 in the LED module 2 to drive the LED load circuits U1 to U3 at a constant current level to achieve uniform light output. The voltage at the nodes between the control elements Q1 to Q3 and switches SW1 to SW3 (referred to as the "monitored voltage" below) is also monitored. Comparators CP1 to CP3 detect short circuit failure and open circuit failure of an LED by comparing the monitored voltage with a specific reference voltage Vref2. The failure controller 5 isolates the failed circuit by means of switches SW1 to SW3 and adjusts reference voltage Vref1 based on comparator output.

The light-emitting element driving device according to the related art described above detects LED failures by comparing the monitored voltage, which is the voltage at the node between each control element (also called a drive current generator) and switch with a fixed reference voltage. However, sudden load variations in the backlight system of a television using an LCD panel can produce overshoot and other voltage fluctuations in the drive voltage output by the DC/DC converter (also called a drive voltage generator). This fluctuation in the drive voltage may also cause the monitored voltage to vary. As a result, even though the LED is operating normally, operation of the comparator that compares the monitored voltage with the fixed reference voltage may cause the failure controller to operate incorrectly.

BRIEF SUMMARY OF THE INVENTION

To solve the foregoing problem, a light-emitting element driving device according to the present invention enables easily and reliably detecting short circuit failure and open circuit failure of light-emitting elements.

A light-emitting element driving device according to the invention includes a light-emitting element load group having a plurality of parallel-connected light-emitting element arrays each having more than one light-emitting elements connected in series; a supply voltage converter that converts a supply voltage and supplies a specific output voltage to the light-emitting element load group; a drive circuit that supplies a load current for driving a light-emitting element connected in series in the light-emitting element array; a power controller that generates a control signal for the supply voltage converter; and a failure detector that detects failure of the light-emitting element. The failure detector monitors the potential of a node between the light-emitting element array and the drive circuit, or a voltage based on this node potential, as a monitored voltage, and detects failure of a light-emitting element based on the monitored voltages of at least two light-emitting element arrays.

EFFECT OF THE INVENTION

The failure detector of a light-emitting element driving device according to the invention detects light-emitting element failure based on comparison of plural monitored voltages. As a result, variation in the monitored voltages resulting from variation in the drive voltage that drives the light-emitting elements can be cancelled by same-phase components, and variation in the monitored voltages caused only by a failed light-emitting element can be detected. Operating errors can therefore be prevented, and light-emitting element failures can be reliably and easily detected. Continued operation of the drive current generator can also be prevented when the monitored voltages applied to the drive circuit increase when a light-emitting element has failed. Power loss in the drive current generator can therefore be reduced, and the safety of the light-emitting element driving device can be improved.

Other objects and attainments together with a fuller understanding of the invention will become apparent and appreciated by referring to the following description and claims taken in conjunction with the accompanying drawings.

DETAILED DESCRIPTION OF THE INVENTION

Figure 1:
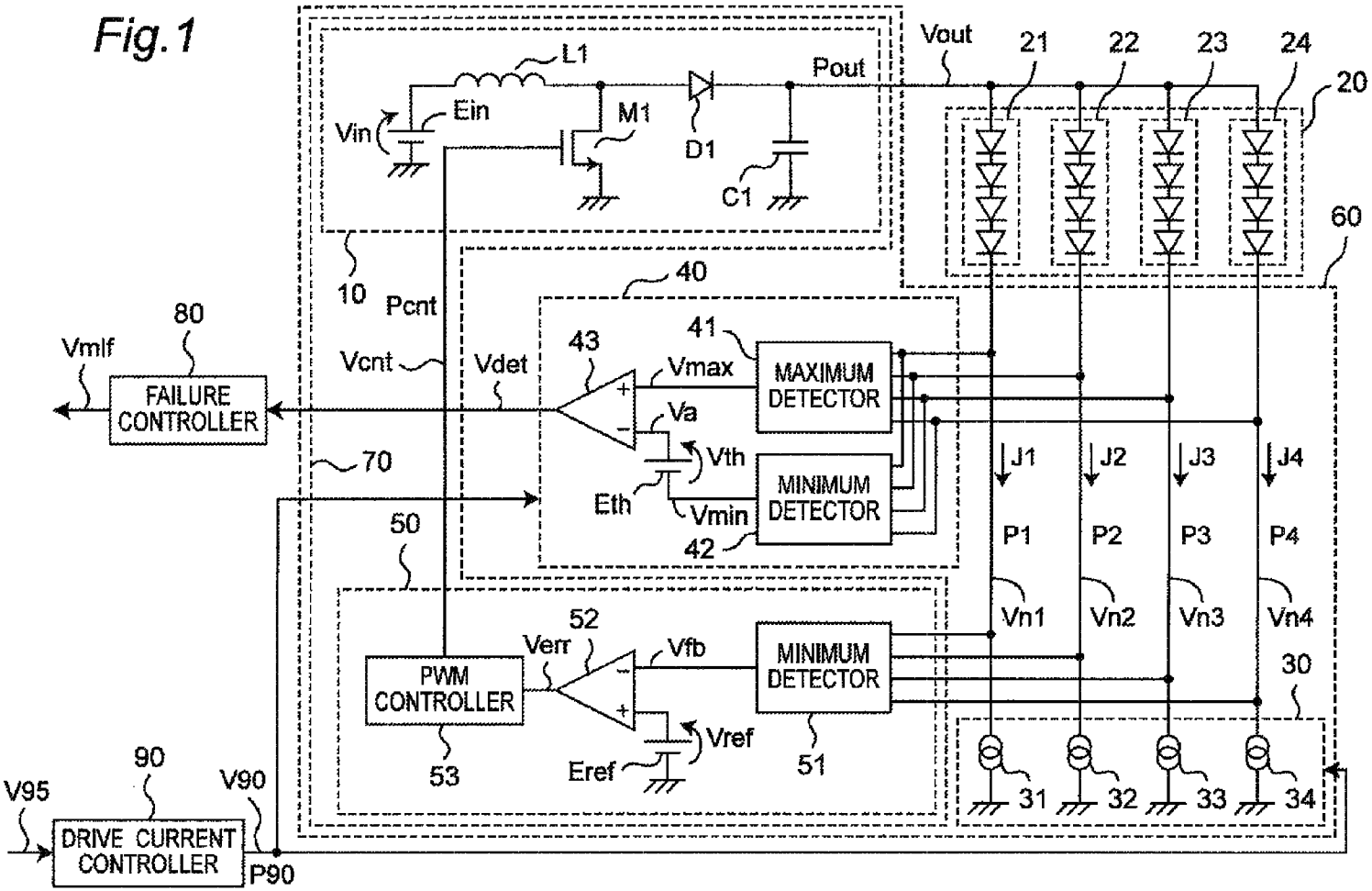
FIG. 1 is a block diagram showing the general configuration of a light-emitting element driving device according to a first embodiment of the invention.

A preferred embodiment of the present invention is described below with reference to the accompanying figures. Elements in the figures having the same configuration, operation, and effect are identified by the same reference numerals. Symbols in the figures are also used in accompanying equations as variables denoting the magnitude of the signals denoted by the symbols.

Embodiment 1

FIG. 1 is a block diagram showing the general configuration of a light-emitting element driving device 60 according to this embodiment of the invention. The light-emitting element driving device 60 includes a drive voltage generator 70, drive current generator group 30, power supply controller 50, failure detector 40, and monitoring paths P1, P2, P3, P4, and drives a light-emitting element array group 20. The drive voltage generator 70 includes the power supply controller 50, supply voltage converter 10, and control path Pcnt.

The light-emitting element array group 20 includes light-emitting element arrays 21, 22, 23, 24. Each light-emitting element array 21 to 24 has N (where N is 1 or more) light-emitting elements. The light-emitting elements in this embodiment of the invention are LEDs (light-emitting diodes), but could be light-emitting elements other than LEDs. One end of each light-emitting element array 21 to 24 is connected to the output path Pout of the supply voltage converter 10. The other end of each light-emitting element array 21 to 24 is connected to a monitoring path P1 to P4, respectively.

The N light-emitting elements rendering light-emitting element array 21 are connected to each other in series so that the forward direction from anode to cathode goes from the output path Pout to the monitoring path P1. The N light-emitting elements rendering light-emitting element arrays 22 to 24 are likewise connected to each other in series so that the forward direction from anode to cathode goes from the output path Pout to the monitoring paths P1 to P4. The light-emitting element array groups are also called light-emitting element load groups.

The drive current generator group 30 includes drive current generators 31, 32, 33, 34. One end of each drive current generator 31 to 34 is respectively connected to monitoring path P1 to P4, and the other end goes to ground. More specifically, monitoring path P1 denotes the connection path between light-emitting element array 21 and drive current generator 31. Likewise, monitoring paths P2 to P4 denote the connection paths between light-emitting element arrays 22 to 24 and drive current generators 32 to 34. The drive current generators 31 to 34 are constant current circuits, and are rendered using current mirror circuits, for example. The drive current generator group 30 is also called a drive circuit group, and the drive current generator is also called a drive circuit.

The drive voltage generator 70 generates and supplies drive voltage Vout through output path Pout to the light-emitting element arrays 21 to 24. The drive voltage Vout is voltage divided by the light-emitting element arrays 21 to 24 and drive current generators 31 to 34. The voltage-divided voltages are voltages between the monitoring paths P1 to P4 and ground, and are respectively called monitored voltages Vn1, Vn2, Vn3, and Vn4 (each equal to the end voltages of drive current generators 31 to 34, respectively). The drive voltage generator 70 adjusts drive voltage Vout based on monitored voltages Vn1 to Vn4. As a result, the light-emitting element driving device 60 stabilizes the drive voltage Vout based on closed-loop control through the control path Pcnt, supply voltage converter 10, light-emitting element array group 20, and monitoring paths P1 to P4. The drive voltage is also called an output voltage.

Based on the video signal V95, the drive current controller 90 generates and supplies a plural channel (four channels in the embodiment shown in FIG. 1) pulse-shaped drive current control signal V90 through path P90 to the drive current generator group 30 and failure detector 40. The drive current generators 31 to 34 are switched on/off based on the drive current control signal V90, and output pulse-shaped drive currents J1, J2, J3, and J4. Drive current generator 31 supplies drive current J1 through monitoring path P1 to the light-emitting element array 21. The other drive current generators 32 to 34 likewise supply drive currents J2 to J4 through monitoring paths P2 to P4 to light-emitting element arrays 22 to 24. The drive current is also called a load current.

The drive current controller 90 changes the duty ratio (the ratio between high and low level periods) of the drive current control signal V90 based on the video signal V95. The drive current generators 31 to 34 individually change the duty ratio (ratio between on and off periods) of the drive currents J1 to J4 based on the four-channel drive current control signal V90. The light-emitting period therefore increases as the duty ratio of the drive current J1 to J4 increases, and the light-emitting periods can be individually adjusted.

When the light-emitting element array group 20 is used as a backlight for an LCD panel, the brightness of the LCD panel must be controlled for the entire LCD panel or individually for each image area addressed by the light-emitting element arrays 21 to 24 in the LCD panel. The drive current generator group 30 is controlled based on the drive current control signal V90, and the brightness of the LCD panel can be adjusted by adjusting the duty.

Note that the drive currents J1 to J4 may be a DC current instead of a pulse current, and the invention is not limited to the foregoing configuration if the brightness of the light-emitting elements can be adjusted by changing an effective value of the actual drive current J1 to J4.

The power supply controller 50 includes a minimum detector 51, error amplifier 52, reference power source Eref, and PWM (pulse width modulation) controller 53. The power supply controller 50 generates and outputs control signal Vcnt based on monitored voltages Vn1 to Vn4 to the control path Pcnt.

The minimum detector 51 generates and outputs minimum monitored voltage Vfb, which denotes the lowest of the monitored voltages Vn1 to Vn4, to the error amplifier 52. The reference power source Eref produces reference voltage Vref. The error amplifier 52 generates and outputs error signal Verr to the PWM controller 53 by amplifying the difference of the reference voltage Vref minus minimum monitored voltage Vfb.

The PWM controller 53 includes a sawtooth voltage generator (not shown in the figure), and the sawtooth voltage generator produces a sawtooth voltage. The PWM controller 53 compares error signal Verr and the sawtooth voltage, generates control signal Vcnt denoting the result of the comparison, and outputs to control path Pcnt. The control signal Vcnt is pulse-width modulated based on the error signal Verr.

As the minimum monitored voltage Vfb becomes lower than the reference voltage Vref, the high level period of the control signal Vcnt becomes longer. Conversely, as the minimum monitored voltage Vfb becomes higher than the reference voltage Vref, the high level period of the control signal Vcnt becomes shorter.

The supply voltage converter 10 includes a power source Ein, coil L1, switching element M1, diode D1, and capacitor C1. The negative pole of the power source Ein goes to ground, and the positive pole is connected through coil L1 to the drain of the switching element M1 and the anode of the diode D1. The source of the switching element M1 goes to ground, and the gate is connected to the control path Pcnt. The cathode of the diode D1 is connected to one side of the capacitor C1 and the output path Pout, and the other side of the capacitor C1 goes to ground.

The power source Ein outputs a specific supply voltage Vin. The supply voltage converter 10 converts supply voltage Vin to drive voltage Vout, supplies drive voltage Vout through output path Pout to the light-emitting element arrays 21 to 24, and adjusts drive voltage Vout based on the control signal Vcnt received through the control path Pcnt.

The control signal Vcnt is applied to the gate of the switching element M1 through the control path Pcnt, and the switching element M1 turns on/off according to the control signal Vcnt. The coil L1 charges and discharges power from the power source Ein as a result of the switching element M1 turning on and off. The diode D1 prevents current backflow from the output path Pout when charging, and passes the stored power forward when discharging. The capacitor C1 stores the passing current and outputs drive voltage Vout to output path Pout. The supply voltage converter 10 is a step-up converter that generates a drive voltage Vout higher than the supply voltage Vin.

As the high level period of the control signal Vcnt becomes longer, the on period of the switching element M1 becomes longer, the coil L1 charging period becomes longer, and drive voltage Vout increases as a result. When drive voltage Vout increases, monitored voltages Vn1 to Vn4 also increase. Conversely, as the high level period of the control signal Vcnt becomes shorter, the on period of the switching element M1 becomes shorter, the coil L1 charging period becomes shorter, and drive voltage Vout decreases as a result. When drive voltage Vout decreases, monitored voltages Vn1 to Vn4 also decrease.

Considering the operation of the power supply controller 50 described above, because the drive voltage Vout increases as the minimum monitored voltage Vfb becomes lower than the reference voltage Vref, monitored voltages Vn1 to Vn4 also increase, and the minimum monitored voltage Vfb is prevented from becoming lower than reference voltage Vref. Conversely, because the drive voltage Vout decreases as the minimum monitored voltage Vfb becomes higher than the reference voltage Vref, monitored voltages Vn1 to Vn4 also decrease, and the minimum monitored voltage Vfb is prevented from becoming higher than reference voltage Vref. The drive voltage generator 70 therefore adjusts drive voltage Vout so that minimum monitored voltage Vfb equals reference voltage Vref.

If reference voltage Vref is set to the lowest voltage enabling the constant current operation of the drive current generators 31 to 34, the desired light output can be achieved from the light-emitting element arrays 21 to 24 while minimizing power consumption by the drive current generators 31 to 34.

While a step-up voltage converter is used as the supply voltage converter 10 in this embodiment of the invention, a step-down voltage converter that outputs a drive voltage Vout lower than the supply voltage Vin can be used instead.

The failure detector 40 includes a maximum detector 41, minimum detector 42, comparator 43, and reference power source Eth.

The failure detector 40 detects device failures in the light-emitting element arrays 21 to 24 and generates failure detection signal Vdet based on the monitored voltages Vn1 to Vn4 and drive current control signal V90. The failure detector 40 also detects device failures in the light-emitting element arrays 21 to 24 based on the monitored voltages Vn1 to Vn4 when the drive current control signal V90 is high.

When the drive current control signal V90 is high, the maximum detector 41 generates maximum monitored voltage Vmax denoting the highest voltage of monitored voltages Vn1 to Vn4.

When the drive current control signal V90 is high, the minimum detector 42 generates minimum monitored voltage Vmin denoting the lowest voltage of monitored voltages Vn1 to Vn4, and outputs to the negative pole of the reference power source Eth.

The reference power source Eth produces reference voltage Vth, and outputs voltage sum Va (=Vmin+Vth), which is the sum of minimum monitored voltage Vmin and reference voltage Vth, from the positive side. The comparator 43 receives maximum monitored voltage Vmax input to the non-inverting input node, and voltage sum Va at the inverting input node, compares the voltages, and outputs failure detection signal Vdet as the result. If the relationship $$V\max > (V\min + Vth) \quad (1)$$

is true, the comparator 43 changes failure detection signal Vdet from low to high, and detects that a light-emitting element failed.

The maximum detector 41 and minimum detector 42 are described as being controlled based on the drive current control signal V90, but the comparator 43 may be controlled based on the drive current control signal V90. More specifically, the comparator 43 may generate failure detection signal Vdet only when drive current control signal V90 is high. The failure detector 40 may thus operate only when drive current control signal V90 is high and appropriately detect a device failure when drive currents J1 to J4 flow to the light-emitting element arrays 21 to 24, and stop detection when drive currents J1 to J4 do not flow.

When failure detection signal Vdet is high, the failure controller 80 generates failure control signal Vmlf. When failure control signal Vmlf is output, the light-emitting element driving device 60 can be protected by isolating one of light-emitting element arrays 21 to 24 from the light-emitting element driving device 60, or isolating power source Ein from the light-emitting element driving device 60.

Note that maximum monitored voltage Vmax may be the highest of monitored voltages Vn1 to Vn4 shifted a specific amount, or may set based on the highest of monitored voltages Vn1 to Vn4. Likewise, minimum monitored voltage Vmin may be the lowest of monitored voltages Vn1 to Vn4 shifted a specific amount, or may be set based on the lowest of monitored voltages Vn1 to Vn4. The failure detector 40 thus detects short circuit failures and open circuit failures of the light-emitting elements based on the magnitude of the difference between the highest and lowest of monitored voltages Vn1 to Vn4.

A specific example of detecting a short circuit failure in one light-emitting element of the light-emitting element arrays 21 to 24 is described next.

When one of the light-emitting elements in light-emitting element array 21 shorts out, the forward voltage (Vout−Vn1) of light-emitting element array 21 decreases an amount equal to the magnitude Vd1 of the forward voltage of the shorted light-emitting element compared with the other light-emitting element arrays 22 to 24. In other words, compared with the other monitored voltages Vn2 to Vn4, monitored voltage Vn1 increases an amount equal to the forward voltage Vd1 of the light-emitting element that short circuited. Therefore, if the variation in the monitored voltages Vn1 to Vn4 before the short circuit failure is assumed to be less than forward voltage Vd1, the increased monitored voltage Vn1 will be the greatest of monitored voltages Vn1 to Vn4. In addition, when a short circuit failure occurs, the maximum detector 41 outputs a maximum monitored voltage Vmax that is higher than before the short circuit failure occurred.

As described above, minimum monitored voltage Vmin is equal to minimum monitored voltage Vfb, and the drive voltage generator 70 works to make minimum monitored voltage Vfb substantially equal to reference voltage Vref. More specifically, when one light-emitting element of the light-emitting element array 21 short circuits, the voltage difference between maximum monitored voltage Vmax and minimum monitored voltage Vmin is higher than or equal to forward voltage Vd1. If reference voltage Vth is set so that $$Vth<Vd1 \quad (2)$$

and the light-emitting element with forward voltage Vd1 shorts out, the comparator 43 changes failure detection signal Vdet from low to high, and the short circuit failure can be detected.

In addition, because there is variation in the forward voltages of the light-emitting elements before an actual short circuit failure occurs, monitored voltages Vn1 to Vn4 are different. Because of this variation in monitored voltages Vn1 to Vn4, operating errors can occur in the failure detector 40, such as changing failure detection signal Vdet from low to high even though a light-emitting element has not actually failed. As a result, reference voltage Vth is set so that $$Vx<Vth \quad (3)$$

where Vx is the variation in monitored voltages Vn1 to Vn4. This enables preventing operating errors in the failure detector 40.

More specifically, using equations 2 and 3, reference voltage Vth is set in the range $$Vx<Vth<Vd1min \quad (4)$$

where Vd1min denotes the lowest forward voltage of the light-emitting elements in the light-emitting element arrays 21 to 24 in the range of variation Vx. As a result, operating errors caused by variation in the forward voltages of the light-emitting elements can be prevented, and a short circuit failure of any one or more light-emitting elements in the light-emitting element arrays 21 to 24 can be reliably detected.

Figure 2:
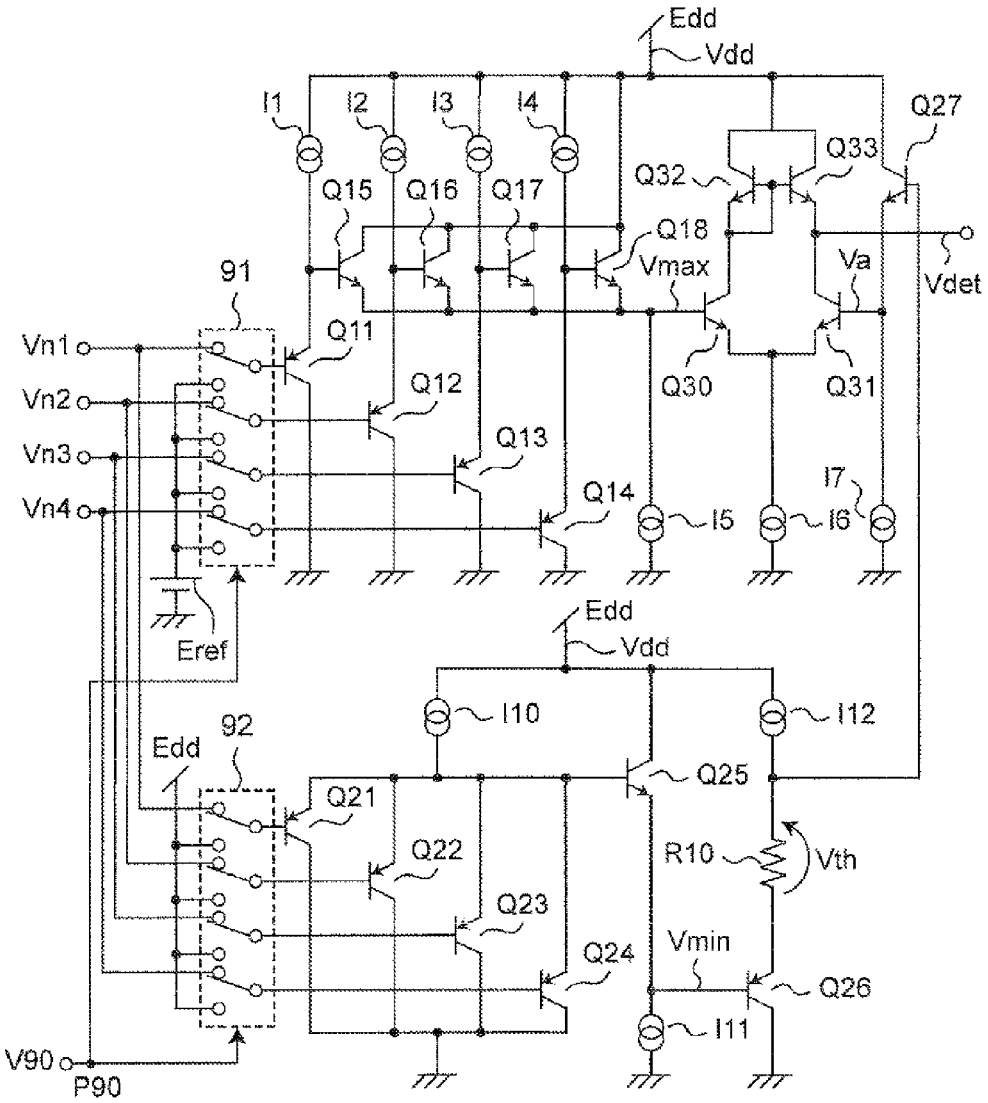
FIG. 2 is a circuit diagram showing the specific configuration of a failure detector contained in the light-emitting element driving device according to the first embodiment of the invention.
Figure 3:
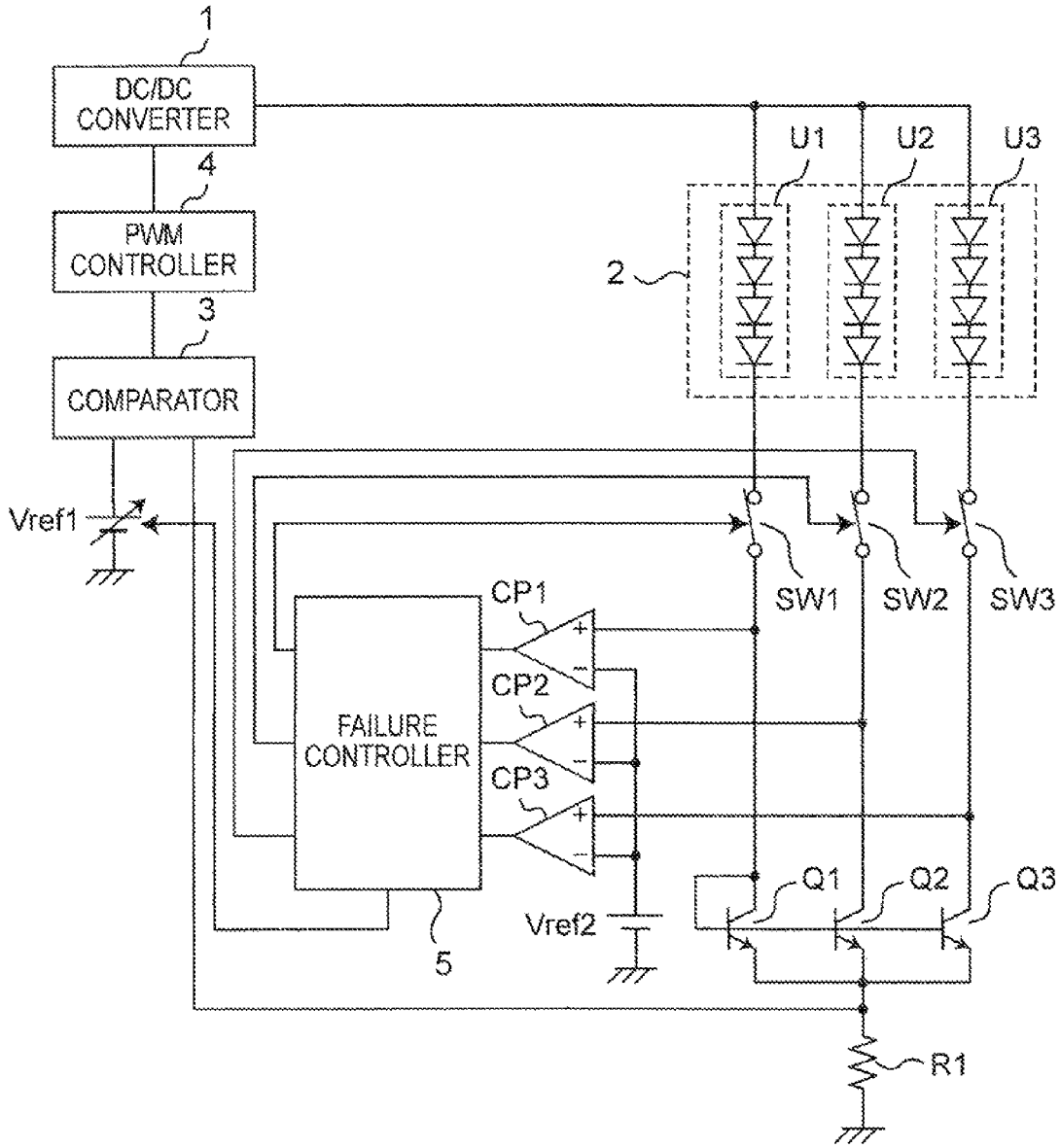
Fig.3 PRIOR ART
FIG. 3 is a block diagram showing the configuration of a light-emitting element driving device according to the related art.

FIG. 2 is a circuit diagram showing a specific example of the failure detector 40. To simplify the following description, the base-emitter voltage Vbe of all transistors is considered to be the same.

Referring to FIG. 2, switch 91 includes four two-input, one-output switches. The four inputs of switch 91 are respectively connected to monitoring paths P1 to P4 in FIG. 1, and the other four inputs are connected in common to the reference power source Eref shown in FIG. 1. The emitters of transistors Q11, Q12, Q13, and Q14 are respectively connected through current sources 11, 12, 13, and 14 to power source Edd and the collectors are connected to a common ground, thus rendering four emitter followers. The bases of transistors Q11-Q14 are respectively connected to the outputs of the four outputs of switch 91. The bases of transistors Q15, Q16, Q17, and Q18 are connected to the emitters of transistors Q11-Q14, and the collectors are connected in common to the power source Edd. The emitters of transistors Q15-Q18 to a common ground through current source 15, and are connected to the base of transistor Q30.

Switch 91 also includes four two-input, one-output switches. The four inputs of switch 92 are respectively connected to monitoring paths P1 to P4 in FIG. 1, and the other four inputs are connected in common to the power source Edd. The emitters of transistors Q21, Q22, Q23, and Q24 are connected in common to the power source Edd through current source 110, the collectors go to a common ground, and the bases are respectively connected to the four outputs of the switch 92. The base of transistor Q25, which renders an emitter-follower, is connected to the emitters of transistors Q21-Q24, the collector is connected to power source Edd, and the emitter goes to ground through current source I11. The base of transistor Q26 is connected to the emitter of transistor Q25, the collector goes to ground, the emitter is connected to one side of resistor R10, and the other side of resistor R10 is connected to power source Edd through current source I12.

The base of transistor Q27, which is an emitter-follower, is connected to the other side of resistor R10, the collector is connected to power source Edd, and the emitter goes to ground through current source 17 and is connected to the base of transistor Q31. Transistors Q30, Q31, Q32, and Q33, and constant current source 16, render a differential amplifier of which the base of transistor Q30 is a non-inverting input terminal, the base of transistor Q31 is an inverting input terminal, and the collector of transistor Q31 is the output.

Switch 91 is controlled based on the drive current control signal V90 from path P90, and selects monitored voltages Vn1 to Vn4 or reference voltage Vref. The drive current control signal V90 is high in the following description.

When drive current control signal V90 is high, switch 91 selects monitored voltages Vn1 to Vn4. Monitored voltages Vn1 to Vn4 are applied to the base of transistors Q15-Q18, respectively. Because transistors Q15-Q18 operate so that only the transistor with the highest base voltage applied to the base goes on, the maximum monitored voltage Vmax described in FIG. 1 is applied to the base of transistor Q30.

Switch 92 is controlled based on the drive current control signal V90 from path P90, and selects monitored voltages Vn1 to Vn4 or voltage Vdd. When drive current control signal V90 is high, switch 92 selects monitored voltages Vn1 to Vn4. Because transistors Q21-Q24 operate so that only the transistor with the lowest base voltage applied to the base goes on, the minimum monitored voltage Vmin described in FIG. 1 is applied to the base of transistor Q26.

The current source I12 supplies a specific current to resistor R10, and produces reference voltage Vth described above in FIG. 1 at both ends of resistor R10. The voltage sum Va (=Vmin+Vth) of minimum monitored voltage Vmin and reference voltage Vth is therefore produced at the base of transistor Q31. The differential amplifier described above therefore receives maximum monitored voltage Vmax at the base (non-inverting input) of transistor Q30, the voltage sum Va at the base (inverting input) of transistor Q31, and outputs failure detection signal Vdet from the collector of transistor Q31.

Because Vdet is approximately equal to Vdd when Vmax>Va, and Vdet is approximately equal to 0 when Vmax<Va, whether or not the difference between maximum monitored voltage Vmax and minimum monitored voltage Vmin is higher than or equal to reference voltage Vth can be determined from the magnitude of failure detection signal Vdet.

Open circuit failures of a light-emitting element can also be detected by the configuration described above by adjusting reference voltage Vref and reference voltage Vth. During normal operation, maximum monitored voltage Vmax and minimum monitored voltage Vmin are defined as follow.

$$Vmax=Vref+Vx \quad (5)$$

$$Vmin=Vref \quad (6)$$

As a result, the difference between Vmax and Vmin during normal operation is $$Vmax-Vmin=Vx \quad (7)$$

that is, equal to the variation Vx in the forward voltage of light-emitting element arrays 21 to 24.

If a connection failure occurs in any one of the light-emitting elements of the light-emitting element array 21, monitored voltage Vn1 will go substantially to zero if the drive current generator 31 is a constant current circuit. In this situation, maximum monitored voltage Vmax and minimum monitored voltage Vmin are as shown in equations 8 and 9.

$$Vmax=Vref+Vx \quad (8)$$

$$Vmin=0 \quad (9)$$

The difference between maximum monitored voltage Vmax and minimum monitored voltage Vmin is therefore as shown in equation 10.

$$Vmax-Vmin=Vref+Vx \quad (10)$$

Comparing equations 7 and 10 shows that the voltage difference of maximum monitored voltage Vmax and minimum monitored voltage Vmin before and after a wiring failure increases by reference voltage Vref. More specifically, by setting reference voltage Vth in the range $$Vx<Vth<Vref \quad (11)$$

the failure detector 40 can detect a connection failure in any light-emitting element.

Note also that reference voltage Vth may be set to less than a multiple M of Vd1min as shown in $$Vx<Vth<M\times Vd1min \quad (12)$$

instead of as shown in equation 4. For example, if M=2, a configuration that detects if two or more light-emitting elements have shorted in any of the light-emitting element arrays 21 to 24 can be achieved.

Note that minimum detector 42 does not need to always produce minimum monitored voltage Vmin as the lowest of monitored voltages Vn1 to Vn4. More specifically, minimum monitored voltage Vmin may be any value that is higher than or equal to the lowest of monitored voltages Vn1 to Vn4 and is less than or equal to the largest monitored voltage that is lower than maximum monitored voltage Vmax. For example, minimum monitored voltage Vmin could be the second highest or the second lowest of the monitored voltages Vn1 to Vn4. More specifically, the minimum detector 42 is not limited to the configuration described above, and can be any configuration that can output a voltage that is less than the maximum monitored voltage Vmax output after a light-emitting element short circuits by at least the forward voltage Vd1 of the light-emitting element that shorted.

Note that to prevent operating errors caused by noise, for example, the failure detector 40 may also be rendered with a timer function and detect if the difference between maximum monitored voltage Vmax and minimum monitored voltage Vmin is higher than or equal to reference voltage Vth during a specified time.

The failure detector 40 and power supply controller 50 in the embodiment described above each have a separate minimum detector 42 and minimum detector 51. However, if the minimum detector 42 and minimum detector 51 are both constructed to detect the lowest of monitored voltages Vn1 to Vn4, the output of either minimum detector may be used by both the failure detector 40 and power supply controller 50. This enables reducing device size by the area occupied by one minimum detector.

As described above, the failure detector 40 in the first embodiment of the invention detects failed light-emitting elements based on a comparison of monitored voltages Vn1 to Vn4. As a result, variation in the monitored voltages Vn1 to Vn4 resulting from variation in the drive voltage Vout that drives the light-emitting elements is cancelled by same-phase components, and variation in the monitored voltages Vn1 to Vn4 caused only by a failed light-emitting element can be detected. Operating errors can therefore be prevented, and light-emitting element failures can be reliably and easily detected. Continued operation of the drive current generators 31 to 34 can also be prevented when the monitored voltages Vn1 to Vn4 applied to the drive current generators 31 to 34 increase when a light-emitting element has failed. Power loss in the drive current generators 31 to 34 can therefore be reduced, and the safety of the light-emitting element driving device 60 can be improved.

Note that numbers used in the foregoing description of the invention are used by way of example only to describe the invention in detail, and the invention is not limited thereto. Logic levels denoted as high and low are also used by way of example only to describe the invention, and it will be obvious that by changing the configuration of the logic circuits the same operation and effect can be achieved by logic levels different from those cited in the foregoing embodiments. Yet further, some components that are rendered by hardware can also be rendered by software, and some components that are rendered by software can also be rendered by hardware. Furthermore, some of the elements described in the foregoing embodiments can be reconfigured in combinations that differ from the foregoing embodiments to achieve the same effects with different configurations while not departing from the scope of the invention.

The invention being thus described, it will be obvious that it may be varied in many ways. Such variations are not to be regarded as a departure from the spirit and scope of the invention, and all such modifications as would be obvious to one skilled in the art are intended to be included within the scope of the following claims.

Use in Industry

The invention can be used in a light-emitting element driving device.

The invention claimed is:

1. A light-emitting element driving device for driving a plurality of light-emitting element strings connected in parallel, the light-emitting element driving device comprising:

a drive circuit group that includes at least two drive circuits and supplies a plurality of drive currents to drive the plurality of light-emitting element strings, respectively;

a failure detector that monitors voltages at a plurality of nodes between a ground and the plurality of light-emitting element strings, and detects a failure of each light-emitting element string of the plurality of light-emitting element strings;

a minimum detector that detects a minimum voltage of the voltages at the plurality of nodes and outputs a certain voltage which represents the minimum voltage; and an error amplifier that receives the certain voltage output from the minimum detector, wherein the drive circuit group independently adjusts a brightness of each of the plurality of light-emitting element strings.

2. The light-emitting element driving device of claim 1, wherein the failure includes a short circuit failure and an open circuit failure.

3. The light-emitting element driving device of claim 1, wherein the voltages at the plurality of nodes are monitored when the drive circuit group is driving the plurality of light-emitting element strings.

4. The light-emitting element driving device of claim 1, wherein the failure detector has a timer function.

5. The light-emitting element driving device of claim 1, wherein the plurality of light-emitting element strings includes a first light-emitting element string, and if the failure detector detects a failure of the first light-emitting element string, the light-emitting element driving device isolates the first light-emitting element string from the light-emitting element driving device.

6. The light-emitting element driving device of claim 1, wherein the drive circuit group changes a duty ratio of each of the plurality of drive currents.

7. The light-emitting element driving device of claim 1, wherein the drive circuit group changes an effective value of each of the plurality of drive currents.

8. The light-emitting element driving device of claim 1, wherein the drive circuit group adjusts the brightness of each of the plurality of light-emitting element strings based on a plural-channel control signal.

9. The light-emitting element driving device of claim 6, wherein the drive circuit group changes the duty ratio of each of the plurality of drive currents based on a plural-channel control signal.

10. The light-emitting element driving device of claim 7, wherein the drive circuit group changes the effective value of each of the plurality of drive currents based on a plural-channel control signal.

11. The light-emitting element driving device of claim 1, further comprising a power controller that generates a control signal to control a transistor, wherein the transistor is connected to the plurality of light-emitting element strings.

12. The light-emitting element driving device of claim 11, further comprising a comparator that controls the power controller.

13. The light-emitting element driving device of claim 11, wherein the power controller is a pulse width modulation controller.

14. The light-emitting element driving device of claim 11, wherein the light-emitting element driving device stabilizes an output voltage generated based on a switching of the transistor by feedback loop control.

15. The light-emitting element driving device of claim 1, wherein the failure detector includes:

a first failure detector that generates a first monitored voltage corresponding to a highest voltage of the voltages at the plurality of nodes;

a second failure detector that generates a second monitored voltage corresponding to one of the voltages at the plurality of nodes, the second monitored voltage being smaller than the first monitored voltage;

a reference power source that generates a reference voltage, and outputs a sum voltage which represents a sum of the second monitored voltage and the reference voltage; and a comparator that compares the first monitored voltage and the sum voltage.

16. A light-emitting element driving device for driving a plurality of light-emitting element strings connected in parallel, the light-emitting element driving device comprising:

a failure detector that monitors voltages at a plurality of nodes between a ground and the plurality of light-emitting element strings, and detects a failure of each light-emitting element string of the plurality of light-emitting element strings;

a drive current controller that generates a plurality of drive current control signals;

a plurality of drive current generators, each drive current generator of the plurality of drive current generators supplying a drive current to a corresponding one of the plurality of light-emitting element strings based on a corresponding one of the plurality of drive current control signals;

a minimum detector that detects a minimum voltage of the voltages at the plurality of nodes and outputs a certain voltage which represents the minimum voltage; and an error amplifier that receives the certain voltage output from the minimum detector, wherein each of the plurality of drive current generators independently adjusts a brightness of the corresponding one of the plurality of light-emitting element strings.

17. The light-emitting element driving device of claim 16, wherein the plurality of light-emitting element strings includes a first light-emitting element string, and if the failure detector detects a failure of the first light-emitting element string, the light-emitting element driving device isolates the first light-emitting element string from the light-emitting element driving device.

18. The light-emitting element driving device of claim 16, wherein each of the plurality of drive current generators changes a duty ratio of the drive current supplied to the corresponding one of the plurality of light-emitting element strings.

19. The light-emitting element driving device of claim 16, wherein each of the plurality of drive current generators changes an effective value of the drive current supplied to the corresponding one of the plurality of light-emitting element strings.

20. The light-emitting element driving device of claim 16, wherein the failure detector includes:

a first failure detector that generates a first monitored voltage corresponding to a highest voltage of the voltages at the plurality of nodes;

a second failure detector that generates a second monitored voltage corresponding to one of the voltages at the plurality of nodes, the second monitored voltage being smaller than the first monitored voltage;

a reference power source that generates a reference voltage, and outputs a sum voltage which represents a sum of the second monitored voltage and the reference voltage; and a comparator that compares the first monitored voltage and the sum voltage.

21. A light-emitting element driving device for driving a plurality of light-emitting element strings connected in parallel, the light-emitting element driving device comprising:

a drive current controller that generates a plurality of drive current control signals; and a plurality of drive current generators, each drive current generator of the plurality of drive current generators supplying a drive current to a corresponding one of the plurality of light-emitting element strings based on a corresponding one of the plurality of drive current control signals, wherein the light-emitting element driving device monitors voltages at a plurality of nodes between a ground and each of the plurality of light-emitting element strings, and detects a failure of each light-emitting element string of the plurality of light-emitting element strings, each of the plurality of drive current generators independently adjusts a brightness of the corresponding one of the plurality of light-emitting element strings, and the light-emitting element driving device includes a minimum detector that detects a minimum voltage of the voltages at the plurality of nodes and outputs a certain voltage which represents the minimum voltage, and an error amplifier that receives the certain voltage output from the minimum detector.

22. The light-emitting element driving device of claim 21, wherein the plurality of light-emitting element strings includes a first light-emitting element string, and if the light-emitting element driving device detects a failure of the first light-emitting element string, the light-emitting element driving device isolates the first light-emitting element string from the light-emitting element driving device.

23. The light-emitting element driving device of claim 21, wherein each of the plurality of drive current generators changes a duty ratio of the drive current supplied to the corresponding one of the plurality of light-emitting element strings.

24. The light-emitting element driving device of claim 21, wherein each of the plurality of drive current generators changes an effective value of the drive current supplied to the corresponding one of the plurality of light-emitting element strings.

25. The light-emitting element driving device of claim 21, further comprising a failure detector that monitors the voltages at the plurality of nodes, and detects the failure of each light-emitting element string of the plurality of light-emitting element strings.

26. The light-emitting element driving device of claim 21, wherein the voltages at the plurality of nodes are monitored when each of the plurality of drive current generators is driving the corresponding one of the plurality of light-emitting element strings.

27. The light-emitting element driving device of claim 1, wherein the light-emitting element driving device includes a pulse width modulation controller and a path between the error amplifier and the pulse width modulation controller.

28. The light-emitting element driving device of claim 16, wherein the light-emitting element driving device includes a pulse width modulation controller and a path between the error amplifier and the pulse width modulation controller.

29. The light-emitting element driving device of claim 21, wherein the light-emitting element driving device includes a pulse width modulation controller and a path between the error amplifier and the pulse width modulation controller.

30. The light-emitting element driving device of claim 1, wherein a voltage different from the minimum voltage is generated based on the minimum voltage.

31. The light-emitting element driving device of claim 16, wherein a voltage different from the minimum voltage is generated based on the minimum voltage.

32. The light-emitting element driving device of claim 21, wherein a voltage different from the minimum voltage is generated based on the minimum voltage.

33. The light-emitting element driving device of claim 1, wherein the certain voltage is the same as the minimum voltage.

34. The light-emitting element driving device of claim 16, wherein the certain voltage is the same as the minimum voltage.

35. The light-emitting element driving device of claim 21, wherein the certain voltage is the same as the minimum voltage.

* * * * *